United States Patent [19]

Miller, Jr. et al.

[11] 4,027,837

[45] June 7, 1977

[54] OPTICAL TRACKING LINK UTILIZING PULSE BURST MODULATION FOR SOLID STATE MISSILE BEACONS

[75] Inventors: Walter E. Miller, Jr.; Jimmy R. Duke, both of Huntsville, Ala.

[73] Assignee: The United States of America as represented by the Secretary of the Army, Washington, D.C.

[22] Filed: Oct. 23, 1969

[21] Appl. No.: 869,452

[52] U.S. Cl. ..... 244/3.16; 244/3.11

[51] Int. Cl.[2] ..... F41G 7/00

[58] Field of Search ..... 244/3.11–3.16

[56] References Cited

UNITED STATES PATENTS

| | | | |
|---|---|---|---|
| 2,923,496 | 2/1960 | Gorden | 244/3.14 |
| 3,219,826 | 11/1965 | Letaw, Jr. | 244/3.16 |
| 3,332,077 | 7/1967 | Nard et al. | 102/70.2 |
| 3,338,534 | 8/1967 | Gersberger | 244/3.14 |
| 3,428,815 | 2/1969 | Thompson | 356/5 |
| 3,494,576 | 2/1970 | Lamelot | 244/3.16 |
| 3,500,050 | 3/1970 | Hillman | 244/3.16 |
| 3,820,742 | 6/1974 | Watkins | 244/3.16 |

*Primary Examiner*—Harold Tudor
*Attorney, Agent, or Firm*—Nathan Edelberg; Robert P. Gibson; Freddie M. Bush

[57] ABSTRACT

An optical tracking link and encoding technique using solid state missile beacons, which easily interfaces with existing missile guidance techniques. Countermeasures hardening is accomplished without sacrifice of performance at maximum range. A solid state, missile beacon within the missile housing transmits a high frequency pulse burst of optical energy during alternate half cycles of a low frequency modulating signal therefor. The optical, modulated signal is received by an optical tracker at the missile launch site, completing an optical link between the missile and the launch site. A visual tracker at the launch site provides line-of-sight contact with a target being tracked. A guidance control for the missile responds to output signals from the missile and visual tracker and develops an error signal between the visual line-of-sight target and the direction of missile travel. Any deviation of the missile from a course of impact with the target causes an error signal to be transmitted to the missile for flight course correction. The solid state beacon includes a clock having a high frequency output thereof modulated at a sub-multiple low frequency thereof and coupled through a power driver to a GaAs, high power diode array, which generates an optical signal in response to a square wave input signal. This pulse burst modulated signal is received by a detector preamplifier of the optical tracker. A diode array in the detector is activated by the impinging optical signal and generates an electrical signal in response to the input wave. This signal is filtered and demodulated to extract the lf modulating wave therefrom. This low frequency is then interfaced with existing error detection equipment for generating a command guidance signal to the missile for error correction.

7 Claims, 4 Drawing Figures

Walter E. Miller, Jr.
Jimmy R. Duke,
INVENTORS.
BY Harry M. Saragovitz
Edward J. Kelly
Herbert Berl
Harold W. Hilton Walter E. Miller, Jr.
Jimmy R. Duke,
INVENTORS.
BY Harry M. Saragovitz
Edward J. Kelly
Herbert Berg
Harold W. Hilton Walter E. Miller, Jr.
Jimmy R. Duke,
INVENTORS.
BY Harry M. Saragovitz
Edward J. Kelly
Herbert Berl
Harold W. Hilton

OPTICAL TRACKING LINK UTILIZING PULSE BURST MODULATION FOR SOLID STATE MISSILE BEACONS

DEDICATORY CLAUSE

The invention described herein may be manufactured, used, and licensed by or for the Government for governmental purposes without the payment to us of any royalties thereon.

BACKGROUND OF THE INVENTION

A coded optical beacon is currently being provided on automatic command to line of sight anti-tank guided missile systems, which provides a unique missile signature for automatic tracking and guidance. This signature should provide discrimination against normal background interference such as fires, horizon, glare, reflection, etc. and; discrimination against deliberate false targets such as flares, searchlights, and other optical jammers. These optical signatures provide a relatively low frequency signal output and are susceptible to false targets (optical jammers) having frequencies in this low frequency range.

One of the most probable sources for application as a high average intensity jammer at relatively low frequencies is the Xenon arc lamp. The frequency response of the Xenon arc lamp is a function of lamp size and current. Increasing the lamp size and increasing input power level reduces the frequency response of the optical output of the lamp. Since these lamps and other similar optical jammers are less efficient at higher frequencies, operation of an optical beacon at a relative high frequency (100Hz or above) is desirable when the high frequency exceeds a maximum boundry of relative effectiveness of the jammers. In the past, high frequency operation of missile beacons has been prohibitive because of the physical characteristics of the radiating devices. Utilization of photodiode sources has overcome these limitations. Since pulse burst modulation (PBM) passes only frequencies within a high frequency passband, Xenon and other relative low frequency jammers offer little significant countermeasures threat to a high frequency coded system. For example, test results of a 75 watt Xenon are lamp indicate that approximately 100 KHz can be construed to be a maximum boundary of relative effectiveness for Xenon jammers.

SUMMARY OF THE INVENTION

An optical tracking link is provided in a command guidance missile system that utilizes pulse burst modulation (PBM) for missile beacons wherein an all solid state, photodiode beacon is employed. One advantage of the solid state beacon over prior art beacons is the extended frequency capability, which allows accomplishment of countermeasures hardening by virtually eliminating low frequency interference. Optical rise time of high power gallium-arsenide (GaAs) diodes permit operation in the megacycle range; however, due to other circuit limitations, operation is limited to a continuous wave upper limit of approximately 2 MHz. The use of diode beacons allows the bulk, weight, and power capabilities to be reduced. High frequency operation of the beacon places a penalty on Xenon arc, tungsten flare and other similar jamming sources, opening the possibility of more sophisticated encoding techniques such as frequency modulation by pulse burst coding. Thus, descrimination against background interference from normal and false optical jammers is provided which is easily adaptable with existing missile guidance techniques.

An optical tracking and guidance control unit is provided for the missile and operated by the person that fires or launches the missile. When a target is selected, the gunner establishes a line-of-sight to the target and fires the missile, maintaining visual contact with the target through the visual tracker (telescope) adjacent the launcher. Since command guidance is controlled from the launch area, no lead or elevation requirements are necessary. Initially the launched missile may be guided (pitch, yaw and roll) by conventional onboard controls, as gyros. During flight the tracker acquires the missile optical source, the gunner maintains tracking contact with the target and the guidance control set detects differences between the gunners line-of-sight and the missile direction, forwarding these signals to the missile to produce pitch and yaw corrections.

When the missile is launched, a solid state optical beacon in the missile begins transmitting modulated optical energy to a similar solid state, optically sensitive receiver adjacent the line-of-sight tracking unit at the launch site, allowing rapid acquistion by the command guidance system. The missile beacon is modulated to transmit a high frequency (hf) pulse burst of energy during alternate half cycles of a low frequency (lf) modulating rate. The transmitted optical signal is received by the optical tracker of the guidance system and the signal is converted to a modulated high frequency electrical signal. This high frequency is filtered to block unwanted signals, demodulated, and filtered to extract the modulating frequency rate therefrom. The lf modulation rate is interfaced with error detection equipment for determining and generating a command guidance signal to the missile. Deviation of the missile from a course of impact with the target causes the correctional signal to be transmitted to the missile by the tracker and guidance control station.

An object of the present invention is to generate a unique optical wave form on a command guided missile by solid state photodiodes and transmit the optical wave to the launch site.

Another object is to receive the optical waveform, detect it from extraneous waves and process it as though it were an amplitude modulated rf carrier.

A further object of the present invention is to provide a closed loop missile tracking system utilizing a high frequency optical link for providing improved countermeasure invulnerability to false beacon signals, and to improve the signal to noise ratio by said unique signal encoding and processing method.

DESCRIPTION OF THE PREFERRED EMBODIMENT

Figure 1:
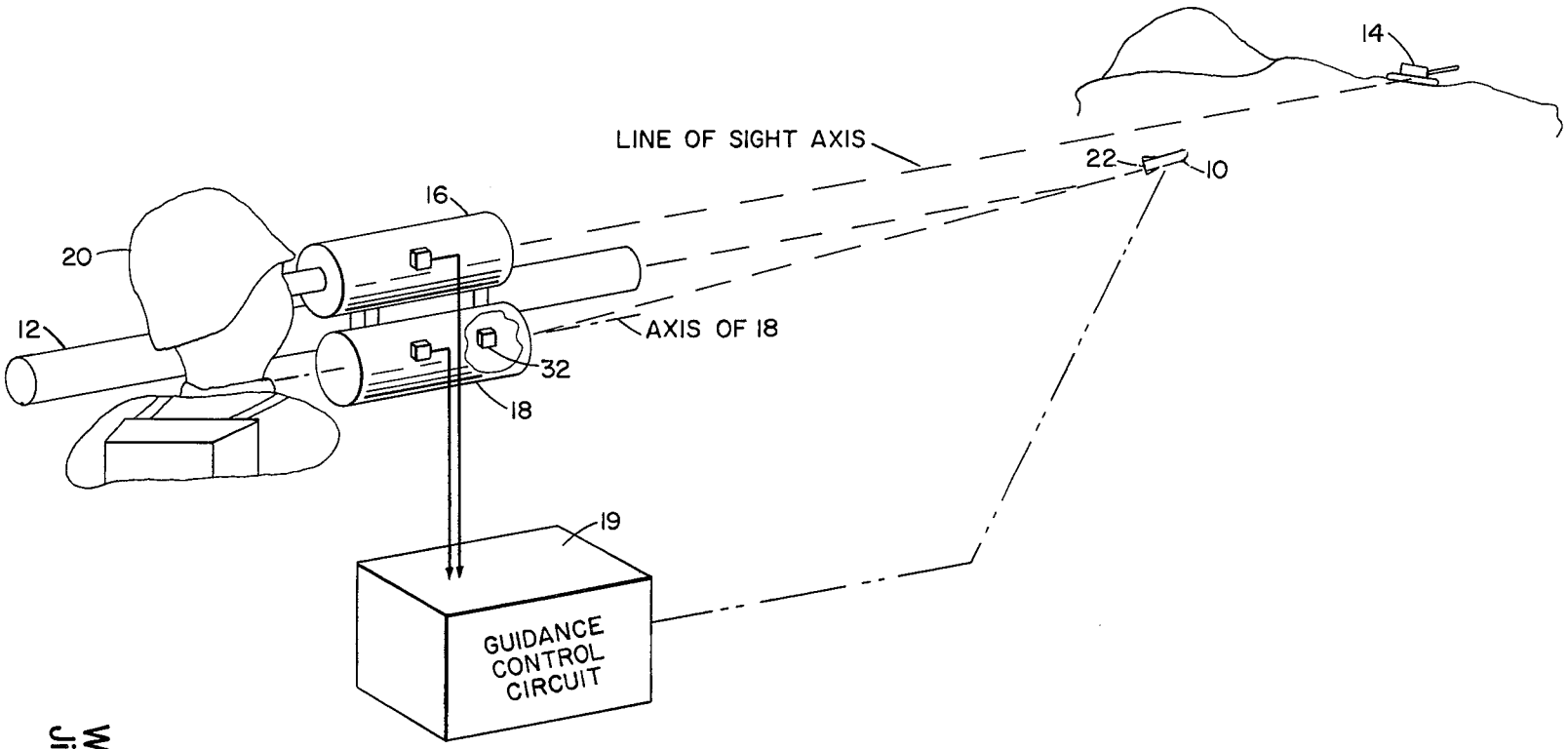
FIG. 1 is a perspective view of a missile system employing an optical tracking link between the missile and the tracker.

Referring now to the drawings, wherein like numerals refer to like parts in each figure, FIG. 1 discloses a system diagram representing a preferred embodiment of the invention wherein a missile 10 is launched from a launching tube 12 in the general direction of a target 14. A guidance control for the missile may be provided by any convenient or desired means as has been used in the prior art, for example — radio frequency control or wire line control of pitch, yaw and roll. To provide control, an observer 20, at the launch site or adjacent thereto, establishes and maintains line-of-sight contact with target 14 through a visual tracker 16. Missile 10 is commanded to align with the longitudinal axis of the visual tracker. Changing the direction of the longitudinal axis of tracker 16 results in a change in the direction of missile 10 as it attempts to realign with the axis of tracker 16. Therefore, maintaining aligned contact with target 14 ensures that the missile will intercept target 14 where the extended longitudinal axis of tracker 16 intercepts the target.

At missile launch, a photoemissive diode beacon 22 is activated in missile 10 and transmits an optical signal toward the launch site, in the general direction of an optical tracker 18. The optical signal impinges on a filtered light sensitive detector 32 within optical tracker 18. The signal is converted to a high frequency electrical signal and processed to produce an error signal relative to deviation from the longitudinal axis of optical tracker 18 to indicate the direction and amount of correction necessary to align missile 10 with target 14. The longitudinal axes of trackers 16 and 18 are fixed in parallel.

Figure 2:
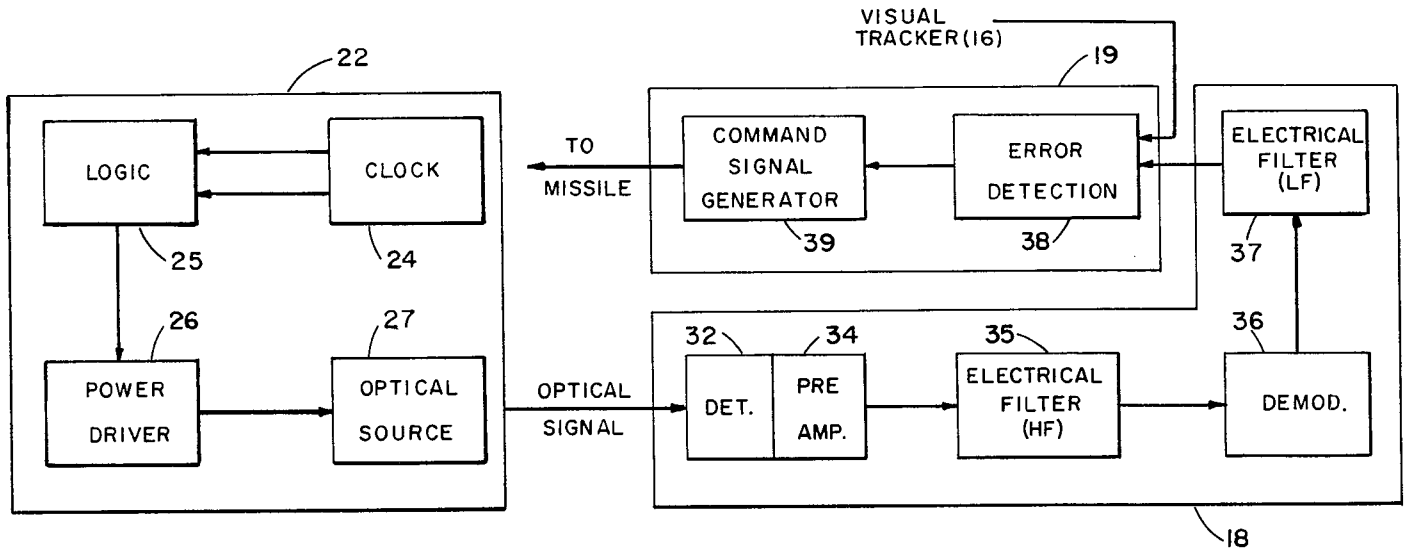
FIG. 2 is a functional block diagram of a missile beacon and a beacon tracker employing the inventive concept.

In the block diagram of FIG. 2, system circuitry is shown in more detail. In beacon 22, a clock 24 generates an electrical hf square wave and a lf sub-multiple thereof, which are combined in a logic circuit 25 to provide a hf output modulated on and off at the 1f rate. The modulated hf output is applied to a power amplifier 26 which drives an optical source 27. The optical output signal from source 27 is received by an optical detector 32 of tracker 18 and is converted back to an electrical signal therein. Optical detector 32 can be a silicon detector. The output of detector 32 is amplified by a preamplifier 34 and is then filtered by a bandpass filter 35 to obtain the modulate hf and eliminate false targets. The hf output of filter 35 is a sine wave, amplitude modulated by the 1f tone, which is demodulated by demodulator 36. An amplitude modulated output envelope from demodulator 36 is filtered by a narrow bandpass 1f filter 37 to select the single 1f tone for interfacing with further signal processing equipment. The 1f tone output of filter 37 is connected to an error detection circuit 38 of guidance control circuit 19. A position signal from visual tracker 16 is also coupled to detection circuit 38 for comparison with the output signal from filter 37. In response to these signals, an error signal is coupled from error detection circuit 38 to command. signal generator 39. A command signal is then transmitted from generator 39 to the missile.

Figure 4:
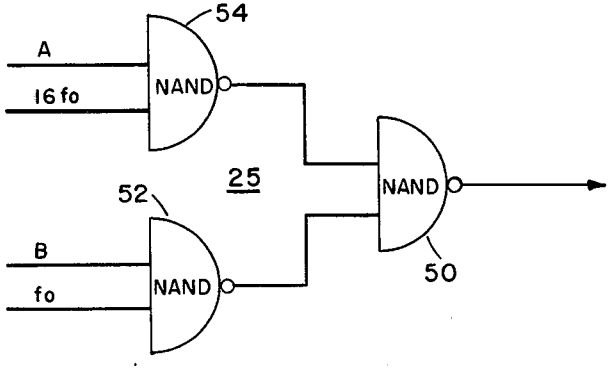
FIG. 4 is a gating logic circuit in the optical beacon.
Figure 3:
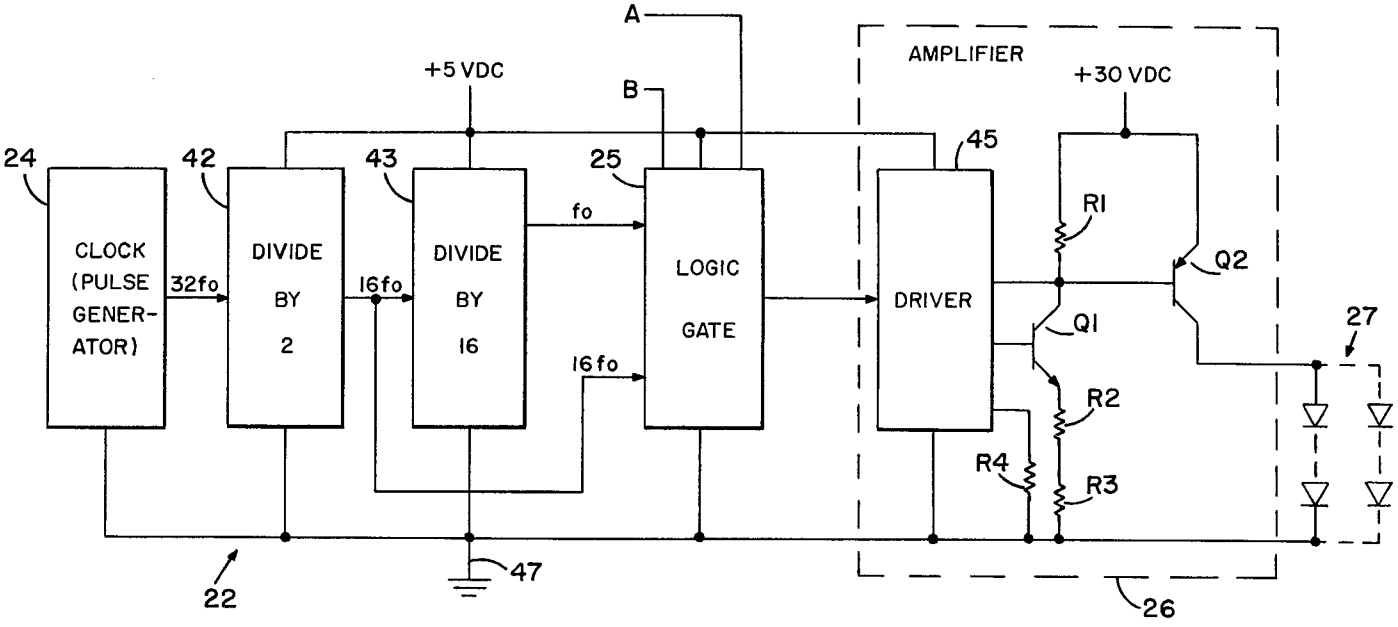
FIG. 3 is a partial schematic of a pulse burst modulation beacon modulator.

A more detailed example of an optical tracking link using high power GaAs diode beacons is disclosed in FIGS. 3 and 4. A clock 24 generates a square wave hf pulse which is connected to a divide-by-two circuit 42. Divider circuit 42 has an output, $16f_o$, connected to divide-by-16 circuit 43 and to a first input of logic gate circuit 25. Divider 43 has an output connected to a second input of gate 25. An output of gate 25 is connected as an input of a driver 45 in power amplifier 26. First and second outputs of driver 45 are respectively connected to the collector electrode and base electrode of transistor Q1, providing both current and voltage amplification. The collector of transistor Q1 is connected to the base of transistor Q2 to drive GaAs diode array 27. The emitter of Q2 (PNP) and the collector of Q1 (NPN) are connected to a positive power source and the collector of Q2 is connected to the anode side of photoemissive array 27. The emitter of Q1 is connected through a series connected pair of resistors R2 and R3 to the cathode side of array 27 and to a circuit ground 47 of beacon 22. A resistor R1 is connected as a load in the collector circuit of Q1 and a resistor R4 serves as a base bias resistor for the driver output transistor (not shown), which is connected with Q1 as a Darlington amplifier.

Logic gate circuit 25 may be a simple two input gate circuit providing a high frequency square wave output burst during positive or alternate half cycles of low frequency rate $f_o$. As seen in FIG. 4, the logic gate includes a NAND gate 50 having a low output for two high input signals. The two input signals of gate 50 are outputs of NAND circuits 52 and 54 respectively, each having a high output signal only when both of the inputs thereto are low. By connecting either input A to ground, input B to ground or neither input to ground, $f_o$ continuous wave, $16f_o$ continuous wave or PBM ($16f_o/f_o$)waveforms respectively may be obtained from the output of NAND gate 50. Thus, NAND circuits 52 and 54 allow beacon operation in more than one mode, with PBM being the principle mode of interest.

The PBM (pulse burst modulation) modulator of FIG. 3 has been constructed and operated to perform the functions indicated in FIG. 1, with the following shelf items:

Clock 24; Crystal controlled oscillator
Divide-by-two circuit 42; Motorola model No. MC848P
Divide-by-16 circuit 43; Motorola model No. MC839P
Logic Gate 25; Motorola model No. MC846P
Amplifier driver 45; Motorola model No. MC943G
Amplifier output stage:
- Q1; 2N2222A
- Q2; 2N1908
- R1; 2,400 ohms
- R2; 56 ohms
- R3; 26 ohms
- R4; 12,000 ohms Photoemissive diodes 27; TI OSX 1209

In operation, clock 24 generates a square wave pulse waveform between zero and +5 volts at a frequency of $32f_o$. Divider circuit 42 receives an input signal from clock 24 and passes the square wave frequency through a frequency division process to generate $16f_o$, the particular carrier of frequency employed. Divider circuit 43 responds to an output of divider 42 and produces a square waveform tone frequency, $f_o$. Tone $f_o$ and carrier $16f_o$ are connected to gate 25, which provides a PBM signal output of $16f_o$ carrier modulated on and off at the $f_o$ tone, when A and B inputs of NAND gates 52 and 54 are not grounded. Amplifier driver 45 receives the modulated carrier and provides both current and voltage amplification as required to drive diode array 27. The optical PBM output waveform of diode array 27 consists of a square wave of $16f_o$ gated by $f_o$, resulting in a pulse burst of 8 pulses, with an equal off time between bursts.

The bursts of optical energy are received and processed as previously stated by optical tracker 18 wheren the $16f_o$ carrier signal is amplified and then half wave rectified by a demodulator to provide the $f_o$ output signal connected to error detector 38. A carrier frequency other than $16f_o$ may, obviously, be used for a particular systems requirements and the modulator clock can be used to generate the immediate carrier. Various other modifications may be made within the scope of the invention, such as using two phase synchronized clocks to generate the carrier and tone frequencies and excluding the divider circuits.

The waveform duty factor of the clock output is not critical. A unijunction transistor oscillator can be used as well as the crystal oscillator to generate the waveform required for system operation. Because of the high frequency capabilities of crystal oscillators, higher multiples of $f_o$ can be used if countdown circuits are employed functioning similar to the divide-by-two circuit.

Comparisons of the relative amplitudes of the PBM signal and CW (continuous wave) signals show the PBM peak signal amplitude is equal to the peak signal amplitude obtained from CW operation while the average power into the diode array is only one half. However since the diode is an average power limited device, the peak current can be increased in PBM operation until the same average input power is dissipated, allowing the diode to operate at the same efficiency as in the CW mode. The effective optical power output in PBM operation will thus be increase in current. Since the PBM waveform is transmitted only half as much as either 1*f* or h*f* continuous wave, and diode power dissipation is a current square function, PBM current should be increased V2 times CW current for equal power dissipation, indicating an increase in the PBM signal-to-noise ratio over that for CW transmission.

We claim:

1. An optical tracking link for interfacing with existing tracking systems for providing a complete closed loop tracking system, comprising: a movable object to be tracked; a photoemissive beacon within the housing of said movable object for transmitting an optical signal; an optical tracker separate from said object for receiving said optical signal and providing an error signal for directional control of said movable object; said beacon including an electronic high frequency generator, a low frequency modulating means for modulating the high frequency output signal of said generator, and a solid state light emitting source responsive to said modulated signal to transmit optical energy at said modulated frequency; said optical tracker including a light sensitive, solid state, optical detector and a preamplifier responsive to said optical energy, providing a preamplified modulated electrical output signal responsive to the modulated optical input, and means for reducing said output signal to obtain the modulation frequency; and said high frequency generator in said beacon including a clock having an output for generating a sub-multiple of said high frequency, a first frequency divider circuit having an output and an input connected to an output of said clock and responsive thereto to provide a high frequency output signal therefrom, and a second frequency divider having an input connected to the output of said first divider and being responsive to said high frequency input thereto to provide a sub-multiple, low frequency output therefrom, a gate circuit having first and second inputs and an output, and an amplifier driver circuit for energizing said solid state light emitting source; said gate circuit having the first input connected to the output of said first divider, and the second input connected to the output of said second divider, for providing a high frequency pulse burst output during each alternate half cycle of said low frequency; and said amplifier driver having an input connected to the output of said gate and an output coupled to said solid state light emitting source to stimulate optical emission therefrom synchronous with said modulated high frequency.

2. An optical tracking link as set forth in claim 1 wherein said optical tracker signal reducing means include a high frequency bandpass filter, a demodulator, and a low frequency bandpass filter, said high frequency bandpass filter having an input connected to an output of said preamplifier, said demodulator having an input connected to an output of said high frequency filter, said low frequency filter having an input connected to an output cf said demodulator, and an output of said low frequency filter being connected to interfacing tracking equipment for providing a command guidance signal thereto.

3. An optical tracking link for interfacing with existing tracking systems for providing a complete closed loop tracking system, comprising: a movable object to be tracked; a photoemissive beacon within the housing of said movable object for transmitting an optical signal; an optical tracker separate from said object for receiving said optical signal and providing an error signal for directional control of said movable object; said beacon including an electronic high frequency generator, a low requency modulating means for modulating the high frequency output signal of said generator, and an optical source responsive to said modulated signal to transmit optical energy at said modulated frequency; and said optical tracker including a detector and preamplifier responsive to said optical energy, providing a preamplified modulated electrical output signal responsive to the modulated optical input, and means for reducing said output signal to obtain the modulation frequency; said photoemissive beacon and said optical tracker detector include a photosensitive solid state diode array for respectively transmitting and receiving an optical signal, said high frequency generator includes a clock for generating both high frequency and low frequency square wave outputs either synchronously or independently, a gate circuit having first and second inputs and an output, and a power amplifier having an output and an input connected to the output of said gate circuit, the first input of said gate circuit being connected to said high frequency clock output and the second gate input being connected to said low frequency clock output, for providing a high frequency pulse burst output during alternate half cycles of said low frequency, and the output of said power amplifier being connected to electrically drive said optical source by stimulating optical emission from said diode array at said modulated high frequency.

4. An optical track link as set forth in claim 3 wherein said movable object is a missile, said optical tracker signal reducing means include a high frequency bandpass filter having an input and an output, a low frequency bandpass filter having an input and an output, and a demodulator between said filters having an input connected to the output of said high frequency filter and an output connected to the input of said low frequency filter, said high frequency filter input being connected to an output of said preamplifier, said low frequency filter output being connected to said interfacing equipment for providing a missile tracking signal.

5. An optical tracking link as set forth in claim 4 wherein said photoemissive diode array includes a plurality of high power gallium-arsenide diodes.

6. A method for providing a high frequency optical tracking link between a missile and a relatively fixed tracking station, said tracking station disposed for distinguishing said target and maintaining said missile in a trajectory terminating at said target, comprising the steps of:

maintaining said target in a line-of-sight relationship with an observer, directing a high frequency burst of optical energy at alternate intervals of a low frequency modulation rate rearwardly from said missile during traversal of said trajectory, receiving and detecting said high frequency optical energy burst, reducing said high frequency signal and obtaining the low frequency modulation waveform therefrom, generating attitude responses in said missile proportional to relative displacement between the missile and said line-of-sight for retention of said missile in said trajectory, generating a high frequency square wave and a low frequency said step of directing a high frequency burst of optical energy at alternate intervals of law frequency modulation rate rearwardly from said missile comprises the steps of;

applying a driver amplifier output signal to a gallium-arsenide diode array for stimulating transmission of said burst of high frequency optical energy from said missile by said diode array.

7. A method for providing an optical tracking link as set forth in claim 6, further comprising the steps of:

receiving and detecting said optical energy burst by a silicon detector within said tracker and producing an electrical high frequency signal responsive thereto, applying the detected high frequency signal to a bandpass filter for elimination of unwanted frequencies, passing said filtered signal through a demodulator and a low frequency filter to obtain said low frequency modulation waveform, and applying the low frequency modulation waveform to an error detection circuit for determining said directional correction signals.

* * * * *

UNITED STATES PATENT OFFICE

CERTIFICATE OF CORRECTION

PATENT NO. : 4,027,837

DATED : June 7, 1977

INVENTOR(S) : Walter E. Miller, Jr. and Jimmy R. Duke

It is certified that error appears in the above-identified patent and that said Letters Patent are hereby corrected as shown below:

Column 8, cancel line 3.
Column 8, line 4, cancel frequency (first occurence).
Column 8, line 5, "law" should read --low--.
Column 8, after line 7, insert:
--generating a high frequency square wave and a low frequency waveform within said missile,
modulating said high frequency wave at said low frequency wave rate for applying bursts of high frequency energy to a driver amplifier during alternate half cycles of the low frequency rate, and--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*